US011066953B2

(12) United States Patent
Ponchak et al.

(10) Patent No.: US 11,066,953 B2
(45) Date of Patent: Jul. 20, 2021

(54) MULTI-PLY HEAT SHIELD ASSEMBLY WITH INTEGRAL BAND CLAMP FOR A GAS TURBINE ENGINE

(71) Applicant: United Technologies Corporation, Farmington, CT (US)

(72) Inventors: Jeffrey D. Ponchak, North Berwick, ME (US); Mark J. Rogers, Kennebunkport, ME (US); James R. Plante, East Waterboro, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 100 days.

(21) Appl. No.: 16/451,336

(22) Filed: Jun. 25, 2019

(65) Prior Publication Data

US 2019/0323381 A1 Oct. 24, 2019

Related U.S. Application Data

(62) Division of application No. 15/215,132, filed on Jul. 20, 2016, now Pat. No. 10,371,005.

(51) Int. Cl.

| | |
|---|---|
| ***F01D 25/14*** | (2006.01) |
| ***F01D 25/26*** | (2006.01) |
| ***F01D 25/24*** | (2006.01) |

(52) U.S. Cl.

CPC ..... *F01D 25/145* (2013.01); *F01D 25/24* (2013.01); *F01D 25/265* (2013.01);
(Continued)

(58) Field of Classification Search

CPC ..... F01M 5/002; F01M 11/02; F01D 9/02; F01D 9/065; F01D 25/18; F01D 25/28;
(Continued)

(56) References Cited

U.S. PATENT DOCUMENTS 3,490,746 A ‡ 1/1970 Bell ..... F01D 25/125 415/177
3,863,445 A * 2/1975 Heath ..... F01N 13/14 60/299

(Continued)

FOREIGN PATENT DOCUMENTS

DE 10331268 A1 ‡ 2/2005 ..... F01D 25/145
DE 102012206090 A1 10/2013

(Continued)

OTHER PUBLICATIONS

European Search Report dated Dec. 1, 2017 for European Patent Application No. 17182419.6.‡

(Continued)

*Primary Examiner* — Craig M Schneider
*Assistant Examiner* — David R Deal
(74) *Attorney, Agent, or Firm* — Bachman & LaPointe, P.C.

(57) ABSTRACT

A heat shield assembly for a gas turbine engine includes a first heat shield ply assembly defined about an axis; a second heat shield ply assembly defined about the axis, the second heat shield ply assembly receivable at least partially over the first heat shield assembly and a band clamp mounted to the second heat shield assembly to circumferentially retain the first heat shield ply assembly and the second heat shield ply assembly.

9 Claims, 7 Drawing Sheets

(52) U.S. Cl.
CPC ..... *F05D 2220/32* (2013.01); *F05D 2230/60* (2013.01); *F05D 2260/231* (2013.01)

(58) Field of Classification Search
CPC .. F02C 7/24; F05D 2230/232; F05D 2240/15; Y02T 50/672
USPC ..... 138/110, 89, 162, 166, 96 R
See application file for complete search history.

(56) References Cited

U.S. PATENT DOCUMENTS 4,087,199 A ‡ 5/1978 Hemsworth ..... F01D 11/08 415/173.3
4,955,193 A * 9/1990 Hoeptner, III ..... B60K 13/04 180/225
5,174,714 A ‡ 12/1992 Plemmons ..... F01D 25/145 29/888
5,195,868 A ‡ 3/1993 Plemmons ..... F01D 25/145 29/525
5,301,986 A ‡ 4/1994 Yehezkeli ..... F16L 23/10 24/279
5,549,449 A ‡ 8/1996 McInerney ..... F01D 25/14 384/41
5,598,696 A ‡ 2/1997 Stotts ..... F02C 7/22 60/740
5,816,043 A * 10/1998 Wolf ..... F01N 13/102 60/272
6,026,846 A * 2/2000 Wolf ..... F01N 13/102 137/375
6,438,949 B1 * 8/2002 Nozaki ..... B60K 13/04 123/184.21
6,530,443 B1 * 3/2003 Tsuruta ..... F01N 13/08 180/89.2
6,598,389 B2 * 7/2003 Chen ..... F01N 13/102 123/169 PH
6,655,153 B2 ‡ 12/2003 Akiyama ..... F01D 5/085 415/11
6,860,110 B2 ‡ 3/2005 Akiyama ..... F01D 5/085 415/11
7,425,023 B2 * 9/2008 Hartig ..... F16L 23/08 24/279
7,458,209 B2 * 12/2008 Hofmann ..... B60R 13/0838 60/322
7,631,497 B2 ‡ 12/2009 Panek ..... F01D 25/186 60/605
7,681,398 B2 ‡ 3/2010 Patel ..... F02C 3/145 60/752
7,686,131 B1 ‡ 3/2010 Osterkamp ..... F01N 13/001 180/89.2
7,703,289 B2 ‡ 4/2010 Rudrapatna ..... F02C 7/222 60/725
7,721,548 B2 ‡ 5/2010 Patel ..... F23R 3/10 60/752
7,748,221 B2 ‡ 7/2010 Patel ..... F23R 3/10 60/752
7,775,047 B2 ‡ 8/2010 Fish ..... F02C 7/222 60/739
7,938,371 B2 ‡ 5/2011 Oga ..... F16L 3/1025 248/55
8,001,792 B1 * 8/2011 Dvorak ..... F01D 9/045 60/799
8,015,816 B2 ‡ 9/2011 Hall ..... F23D 11/38 239/53
8,091,296 B2 ‡ 1/2012 Horn ..... E04D 13/14 52/101
8,376,721 B2 ‡ 2/2013 Thayer ..... F02B 39/00 417/36
8,844,643 B2 * 9/2014 Mickelsen ..... A62C 3/08 169/62
8,899,924 B2 ‡ 12/2014 Alvanos ..... F01D 5/081 416/11
8,985,533 B2 ‡ 3/2015 Edmond ..... F16L 3/227 248/68.1
9,021,812 B2 ‡ 5/2015 Pardington ..... F23R 3/14 60/748
2006/0193721 A1 ‡ 8/2006 Adam ..... F01D 25/145 415/177
2012/0287588 A1 ‡ 11/2012 Muterspaugh ..... H05K 9/006 361/752
2014/0140828 A1 5/2014 Rioux
2016/0123187 A1 ‡ 5/2016 Leslie ..... F01D 25/145 415/13

FOREIGN PATENT DOCUMENTS

EP 3026228 A1 6/2016
IE 10331268 A1 2/2005
WO 2014143296 A1 9/2014
WO 2014201247 A1 12/2014
WO WO-2014201247 A1 ‡ 12/2014 ..... F01D 25/145
WO 2015102702 A2 7/2015

OTHER PUBLICATIONS

Extended European Search Report dated Mar. 13, 2018 for European Patent Application No. 17182419.6.‡
Partial European Search Report dated Mar. 12, 2020 issued for corresponding European Patent Application No. 19197725.5.

* cited by examiner
‡ imported from a related application

MULTI-PLY HEAT SHIELD ASSEMBLY WITH INTEGRAL BAND CLAMP FOR A GAS TURBINE ENGINE

This application is a divisional of U.S. patent application Ser. No. 15/215,132 filed Jul. 20, 2016.

BACKGROUND

The present disclosure relates to a gas turbine engine and, more particularly, to a heat shield arrangement therefor.

Thermal shields are used in gas turbine engines to thermally isolate particular structures from an active heat transfer environment. The effectiveness of these shields, which may be a combination of a metal foil backing enclosing an insulation type blanket next to the structure, is directly dependent upon having no gaps or channels between the blanket and the structure and upon the blankets retaining their original shape. Gaps or channels between the blanket and the structure have an inherent "flow leak." Leaks have an associated flow velocity that can generate a significant heat transfer coefficient. Gaps between the heat shield and engine case structure allow fluid to flow out of the case structure.

Thermal distortions and part-to-part tolerances may compromise the ability of the heat shield to operate as an effective seal. Most heat shields used in standard turbine/compressor design applications, have an "inside" radial fit-up. This radial fit-up is not readily controlled effectively during engine transient operation. In addition, vibration of the engine structure can cause the fibrous insulation blanket to deteriorate and lose shape thereby providing a flow path between the blanket and the structure insulated by the blanket.

SUMMARY

A heat shield assembly for a gas turbine engine according to one disclosed non-limiting embodiment of the present disclosure can include a first heat shield ply assembly defined about an axis; a second heat shield ply assembly defined about the axis, the second heat shield ply assembly receivable at least partially over the first heat shield assembly; and a band clamp to circumferentially retain the first heat shield ply assembly and the second heat shield ply assembly.

A further embodiment of the present disclosure may include wherein the first heat shield ply assembly includes four segments.

A further embodiment of the present disclosure may include, wherein the second heat shield ply assembly includes two segments.

A further embodiment of the present disclosure may include, wherein the first heat shield ply assembly is an inner heat shield and the second heat shield ply assembly is an outer heat shield.

A further embodiment of the present disclosure may include, wherein the band clamp includes a spring to permit circumferential movement of the heat shield assembly.

A further embodiment of the present disclosure may include, wherein the spring is located between a nut and a dowel that are received on a T-bolt.

A further embodiment of the present disclosure may include, wherein the second heat shield ply is thicker than the first heat shield ply.

A further embodiment of the present disclosure may include, wherein the second heat shield ply assembly includes a stiffening bar.

A further embodiment of the present disclosure may include, wherein the band clamp is riveted to the second heat shield ply.

A further embodiment of the present disclosure may include, wherein the second heat shield ply includes a locating lobe to at least partially axially retain the band clamp.

A gas turbine engine according to one disclosed non-limiting embodiment of the present disclosure can include a first case segment with a first flange; a second case segment with a second flange and a third flange, a first interface defined by the second flange and the first flange; a first multiple of bolts that extend through the first interface; a third case segment with a fourth flange, a second interface defined by the fourth flange and the third flange; a second multiple of bolts that extend through the second interface; and a heat shield assembly that extends at least partially around the first multiple of bolts and the second multiple of bolts.

A further embodiment of the present disclosure may include, wherein the heat shield assembly seals in an axial and a radial direction.

A further embodiment of the present disclosure may include, wherein the heat shield assembly spans the second case segment.

A further embodiment of the present disclosure may include, wherein the first multiple of bolts includes first bolt heads that are directed in first direction and the second multiple of bolt heads extend in a second direction opposite the first direction, the heat shield surrounds the first bolt heads and the second bolt heads.

A further embodiment of the present disclosure may include, wherein the heat shield assembly comprises: a first heat shield ply assembly defined about an axis; and a second heat shield ply assembly defined about the axis, the second heat shield ply assembly receivable at least partially over the first heat shield assembly.

A further embodiment of the present disclosure may include, wherein the heat shield assembly comprises a band clamp mounted to the second heat shield assembly to circumferentially retain the first heat shield ply assembly and the second heat shield ply assembly.

A method of assembling a heat shield assembly to a gas turbine engine, according to one disclosed non-limiting embodiment of the present disclosure can include: locating a first heat shield ply assembly at least partially around a first multiple of bolts in a first flange interface and a second multiple of bolts in a second flange interface; and locating a second heat shield ply assembly at least partially over the first heat shield ply assembly.

A further embodiment of the present disclosure may include band clamping the second heat shield ply assembly at least partially over the first heat shield ply assembly A further embodiment of the present disclosure may include invoking an axial force on the first heat shield ply assembly which causes the first heat shield ply assembly to seal against the respective case flanges.

A further embodiment of the present disclosure may include axially retaining a band clamp to the second heat shield ply assembly.

The foregoing features and elements may be combined in various combinations without exclusivity, unless expressly indicated otherwise. These features and elements as well as the operation of the invention will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
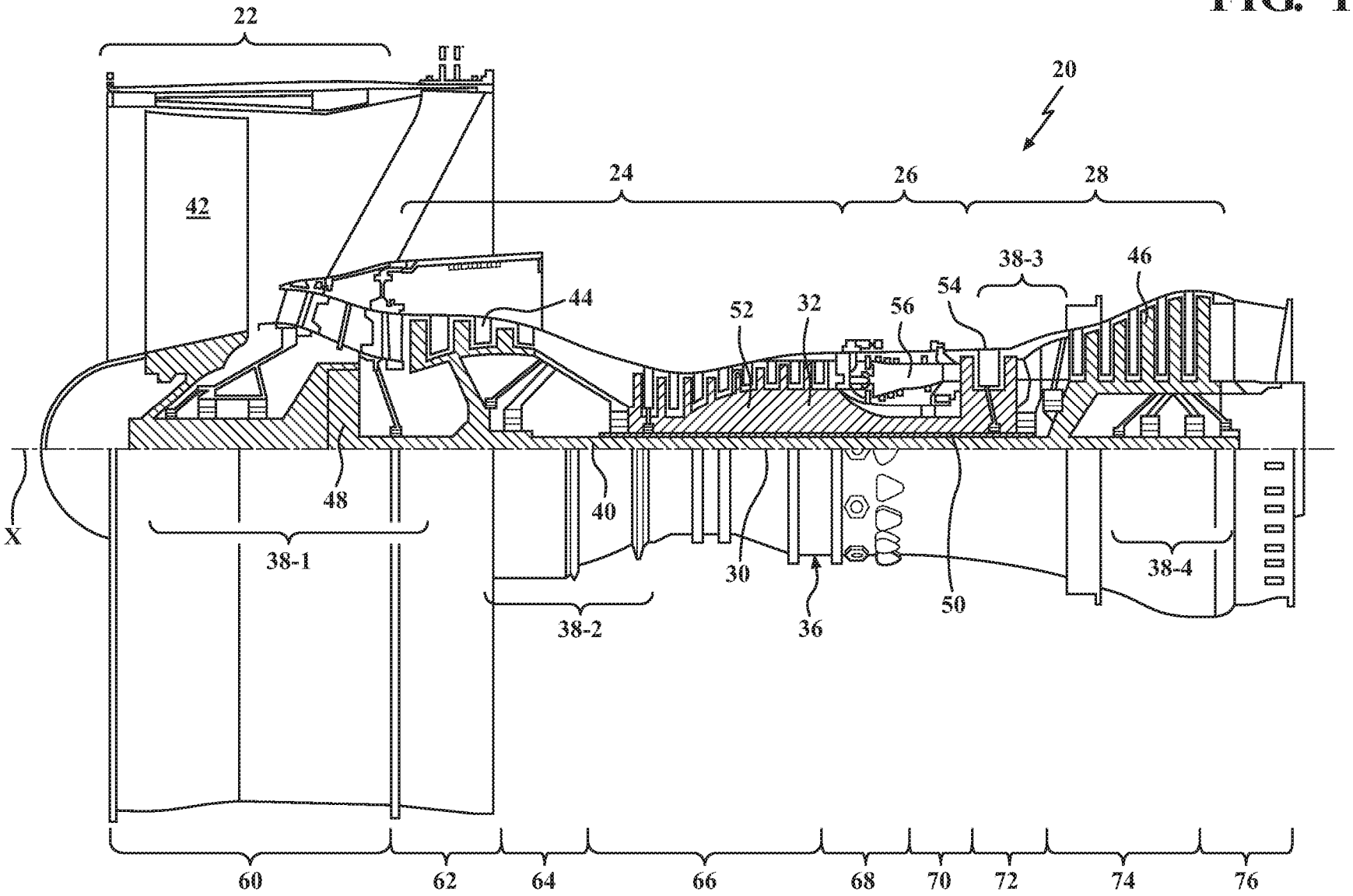
FIG. 1 is a schematic cross-sectional view of a geared architecture gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines architectures such as a low-bypass turbofan may include an augmentor section (not shown) among other systems or features. Although schematically illustrated as a turbofan in the disclosed non-limiting embodiment, it should be understood that the concepts described herein are not limited to use with turbofans as the teachings may be applied to other types of turbine engines to include but not limited to a three-spool (plus fan) engine wherein an intermediate spool includes an intermediate pressure compressor (IPC) between a low pressure compressor and a high pressure compressor with an intermediate pressure turbine (IPT) between a high pressure turbine and a low pressure turbine as well as other engine architectures such as turbojets, turboshafts, open rotors and industrial gas turbines.

The fan section 22 drives air along a bypass flowpath and a core flowpath while the compressor section 24 drives air along the core flowpath for compression and communication into the combustor section 26 then expansion through the turbine section 28. The engine 20 generally includes a low spool 30 and a high spool 32 mounted for rotation about an engine central longitudinal axis A relative to an engine case assembly 36 via several bearing compartments 38.

The low spool 30 generally includes an inner shaft 40 that interconnects a fan 42, a low-pressure compressor 44 ("LPC") and a low-pressure turbine 46 ("LPT"). The inner shaft 40 drives the fan 42 through a geared architecture 48 to drive the fan 42 at a lower speed than the low spool 30. The high spool 32 includes an outer shaft 50 that interconnects a high-pressure compressor 52 ("HPC") and high-pressure turbine 54 ("HPT"). A combustor 56 is arranged between the HPC 52 and the HPT 54. The inner shaft 40 and the outer shaft 50 are concentric and rotate about the engine central longitudinal axis A that is collinear with their longitudinal axes.

Core airflow is compressed by the LPC 44 then the HPC 52, mixed with the fuel and burned in the combustor 56, then expanded over the HPT 54 and the LPT 46. The HPT 54 and the LPT 46 drive the respective low spool 30 and high spool 32 in response to the expansion.

In one example, the gas turbine engine 20 is a high-bypass geared architecture engine in which the bypass ratio is greater than about six (6:1). The geared architecture 48 can include an epicyclic gear system, such as a planetary gear system, star gear system or other system. The example epicyclic gear train has a gear reduction ratio of greater than about 2.3, and in another example is greater than about 2.5 with a gear system efficiency greater than approximately 98%. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one non-limiting embodiment, a significant amount of thrust is provided by the bypass flow due to the high bypass ratio. The fan section 22 of the gas turbine engine 20 is designed for a particular flight condition—typically cruise at about 0.8 Mach and about 35,000 feet (10668 m). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"Tram"}/518.7)^{0.5}$. The Low Corrected Fan Tip Speed according to one non-limiting embodiment of the example gas turbine engine 20 is less than about 1150 fps (351 m/s).

Figure 3:
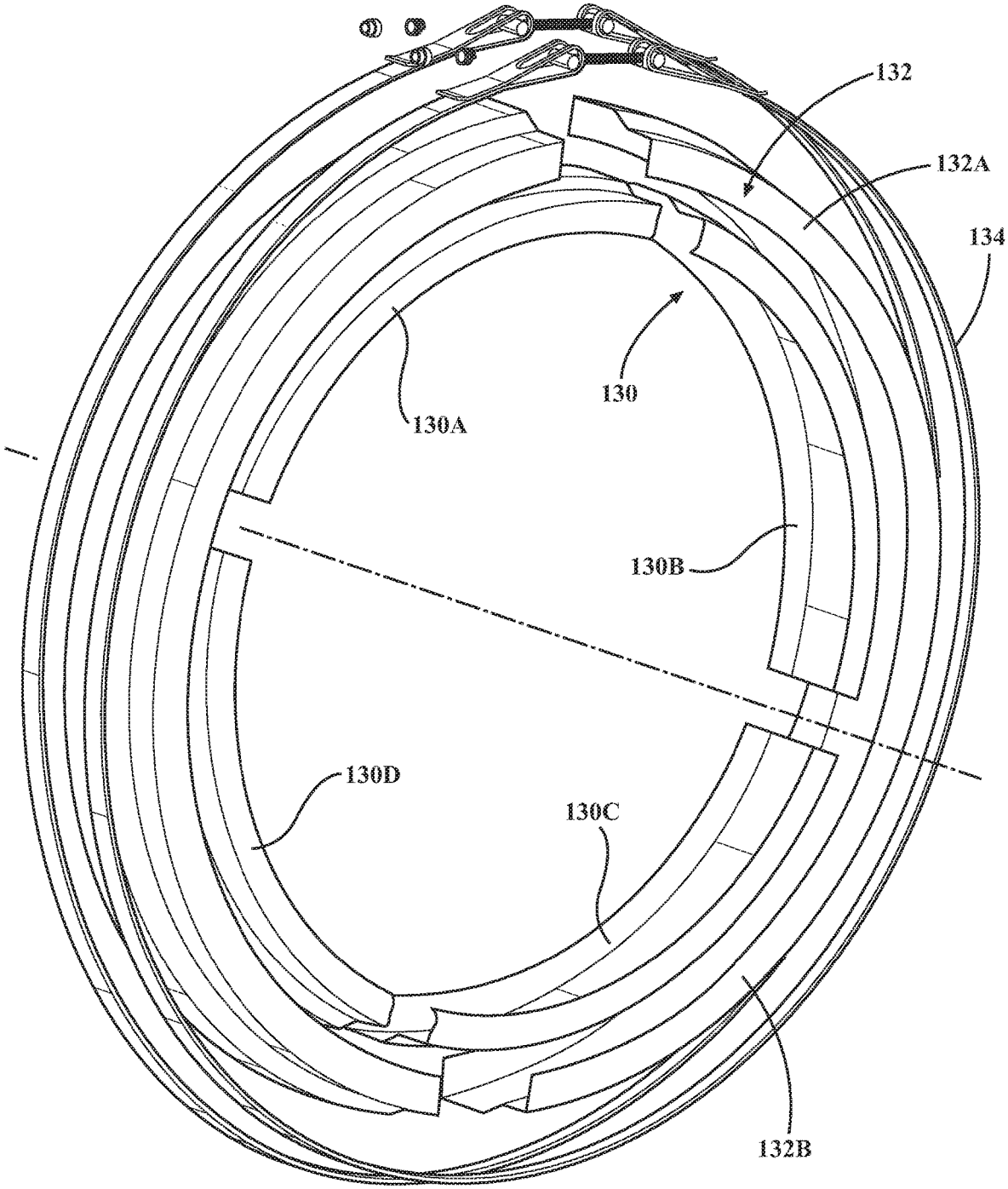
FIG. 3 is an exploded view of a heat shield.

The engine case assembly 36 generally includes a multiple of modules to include a fan case module 60, an intermediate case module 62, an LPC module 64, a HPC module 66, a diffuser module 68, a HPT module 70, a mid-turbine frame (MTF) module 72, a LPT module 74, and a Turbine Exhaust Case (TEC) module 76 (FIG. 3). It should be understood that additional or alternative modules might be utilized to form the engine case assembly 36.

Figure 2:
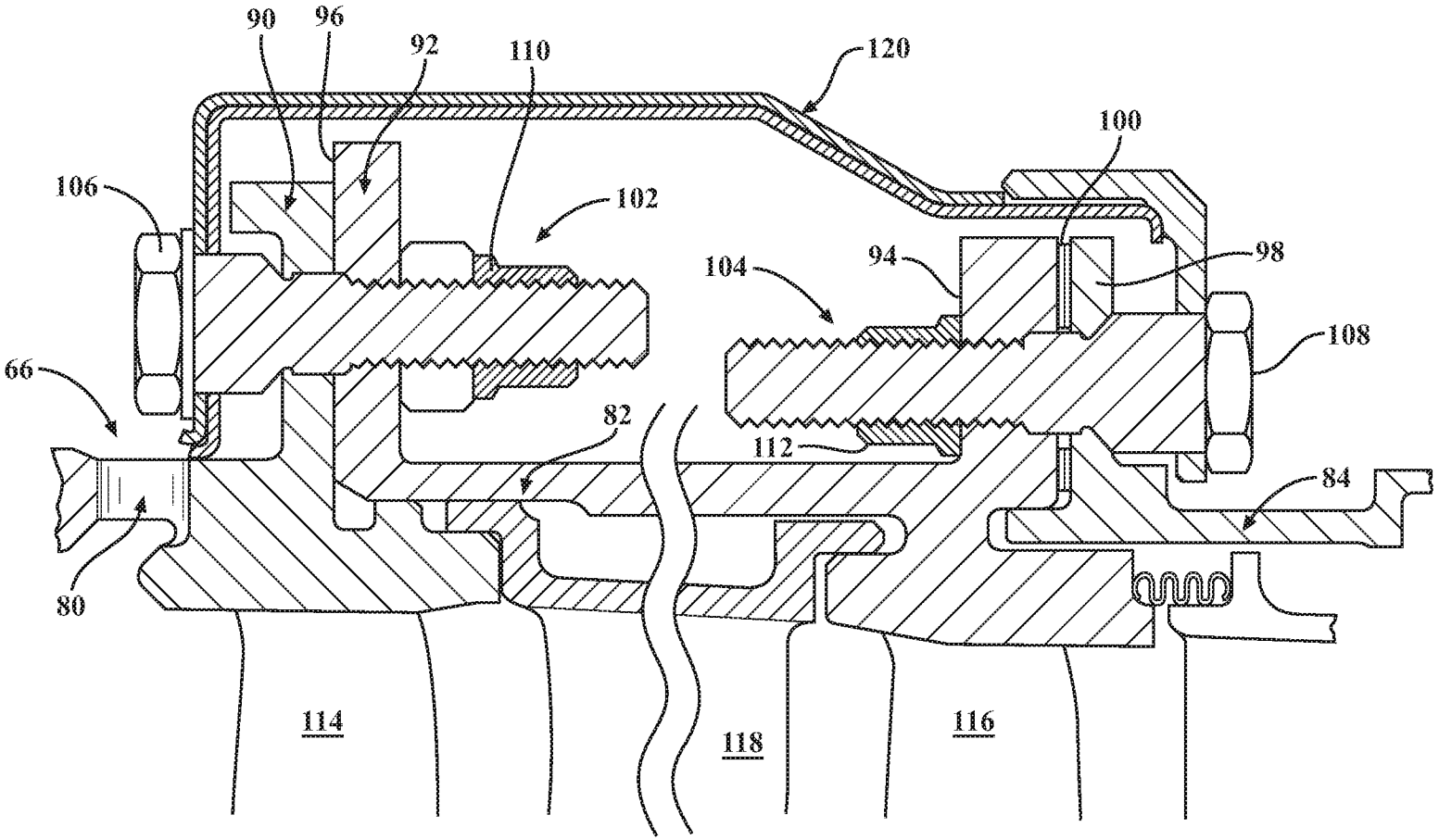
FIG. 2 is an expanded longitudinal schematic sectional view of a case module with a heat shield.

With reference to FIG. 2, in one disclosed non-limiting embodiment, a portion of the HPC module 66 includes a first case segment 80, a second case segment 82, and a third case segment 84. It should be appreciated that although the HPC module 66 is illustrated, other modules with flanges will also benefit herefrom. The first case segment 80 includes a first flange 90, the second case segment 82 includes a second flange 92 and a third flange 94 and a third case segment 84 includes a fourth flange 98. The first and second flange 90, 92 defines a first interface 96 and the third and a fourth flange 94, 98 defines a second interface 100. The first case segment 80 and the third case segment 84 are outboard of a rotor 114, 116 while the second case segment 82 is outboard of a stator assembly 118.

The first interface 96 and the second interface 100 are respectively retained together by a multiple of fasteners 102, 104. The fasteners include respective heads 106, 108 that are directed outboard of the third case segment 84. That is, the nuts 110, 112 mounted to the respective fasteners 102, 104 are located adjacent to the second case segment 82 between the second flange 92 and the third flange 94.

In this disclosed non-limiting embodiment, a heat shield assembly 120 spans the first flange 90 and the fourth flange 98 to also encompass the bolt heads 106, 108. That is, the heat shield assembly 120 provides both radial and axial thermal protection to minimize thermal excursions and facilitate thermal stabilization of a blade tip clearance for the rotors 114, 116.

With reference to FIG. 3, the heat shield assembly 120 generally includes an inner heat shield ply assembly 130 defined around the engine axis, a outer heat shield ply assembly 132 defined about the engine axis, and at least one band clamp 134 around the outer heat shield ply assembly 132. In one embodiment, the inner heat shield ply assembly 130 may be formed of a multiple of segments (four 90 degree segments illustrated; 130A-130D) and the outer heat shield ply assembly 132 may be formed of a multiple of segments (two 180 degree segments illustrated; 132A-132B). The inner heat shield ply assembly 130 may be formed with a slight outward angle to clear the flanges/bolts (FIG. 4).

The inner heat shield ply assembly 130 and the outer heat shield ply assembly 132 may be respectively manufactured of a nickel alloy that is the equivalent or different. For example, the outer heat shield ply assembly 132 may have a greater coefficient of thermal expansion than the inner heat shield ply assembly 130. In another example, the outer heat shield ply assembly 132 may be thicker than the inner heat shield ply assembly 130. The outer heat shield ply assembly 132 is receivable at least partially over the inner heat shield assembly 130 to retain the segments thereof.

Figure 4:
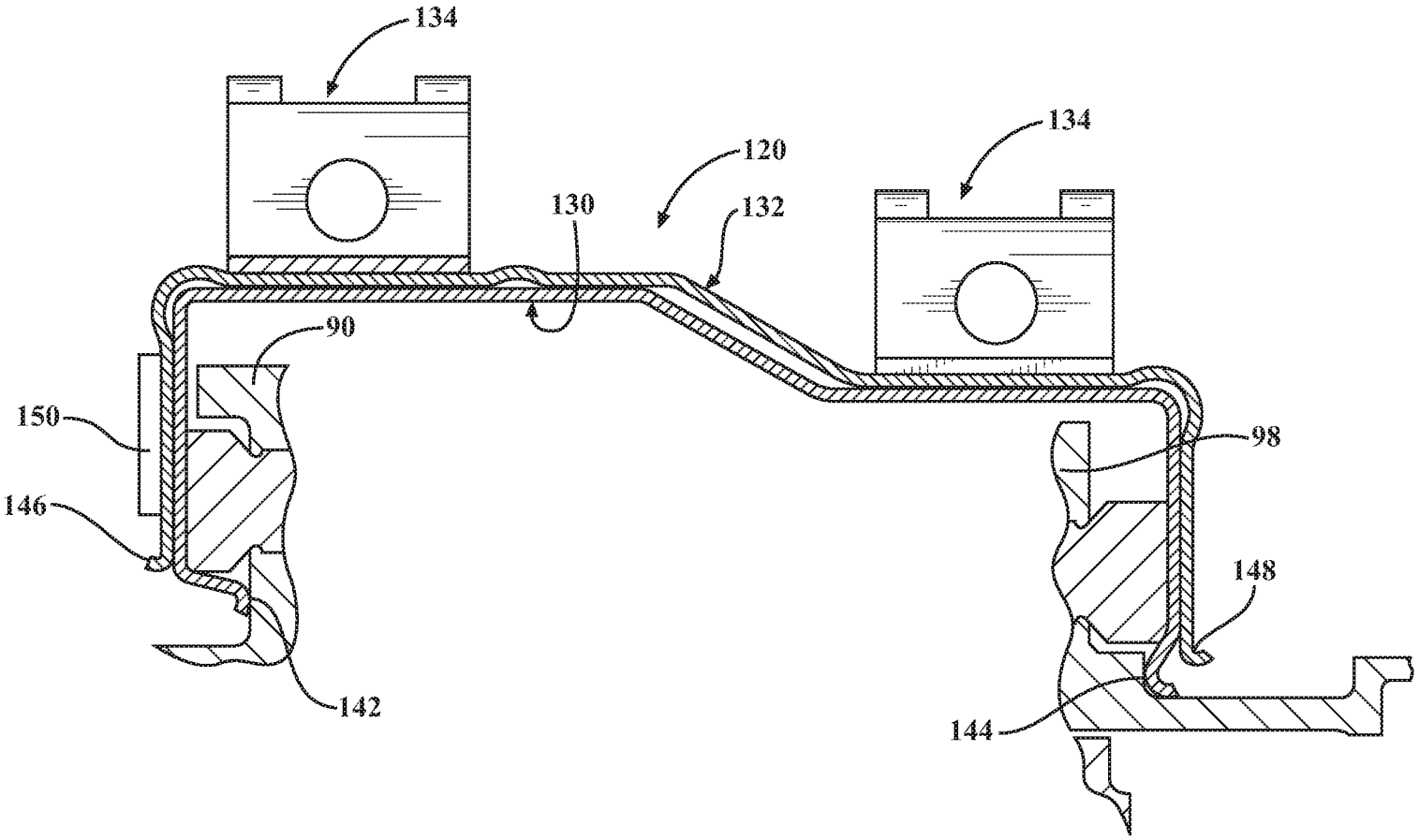
FIG. 4 is an expanded longitudinal sectional view of a heat shield in an assembled condition.

With reference to FIG. 4, the inner heat shield ply assembly 130 include lips, 142, 144 that may provide an interference fit with the respective first flange 90, and fourth flange 98. That is, the inner heat shield ply assembly 130 facilitates a tight fit with the flanges 90, 98. The outer heat shield ply assembly 132 includes lips, 146, 148, which may provide an interference fit with the inner heat shield ply assembly 130. That is, the outer heat shield ply assembly 132 essentially snaps over the inner heat shield ply assembly 130.

The outer heat shield ply assembly 132 may also include radial stiffeners 150 such as welds, bars, or other features to stiffen the outer heat shield ply assembly 132 and thereby increase the axial retention forces. Various manufacturing rudiments may be utilized to facilitate assembly such as wax that retains the segments but is then burned cleanly away on a "green" run.

Figure 5:
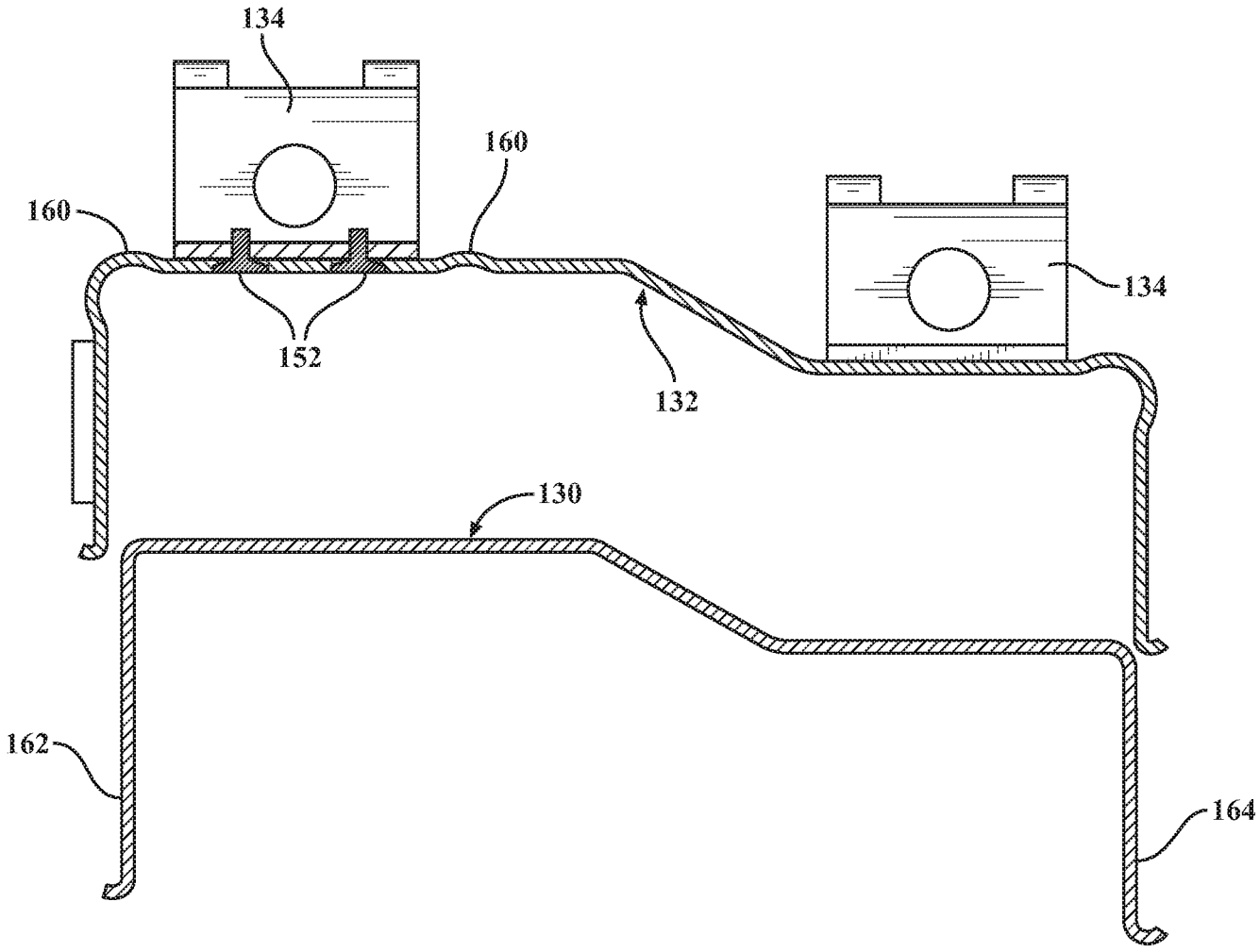
FIG. 5 is an expanded longitudinal sectional view of a heat shield in an unassembled condition.

The band clamp 134 is mounted to the outer heat shield assembly 132 to circumferentially retain the inner heat shield ply assembly 130 and the second heat shield ply assembly 132. The band clamp 134 may be riveted with rivets 152, welded, or otherwise affixed to the outer heat shield assembly 132 (FIG. 5). The outer heat shield assembly 132 may also include circumferential contours 160 to facilitate axial retention of the band clamp 134.

The inner heat shield ply assembly 130 may include convolutes 162, 164 on forward and aft axial extending surfaces. The outer heat shield ply assembly 132 contacts the convolutes 162, 164 and when band clamped inboard, the outer heat shield ply assembly 132 invokes an axial force on the inner heat shield ply assembly 130 which causes the inner heat shield ply assembly 130 to seal against the respective case flanges.

Figure 6:
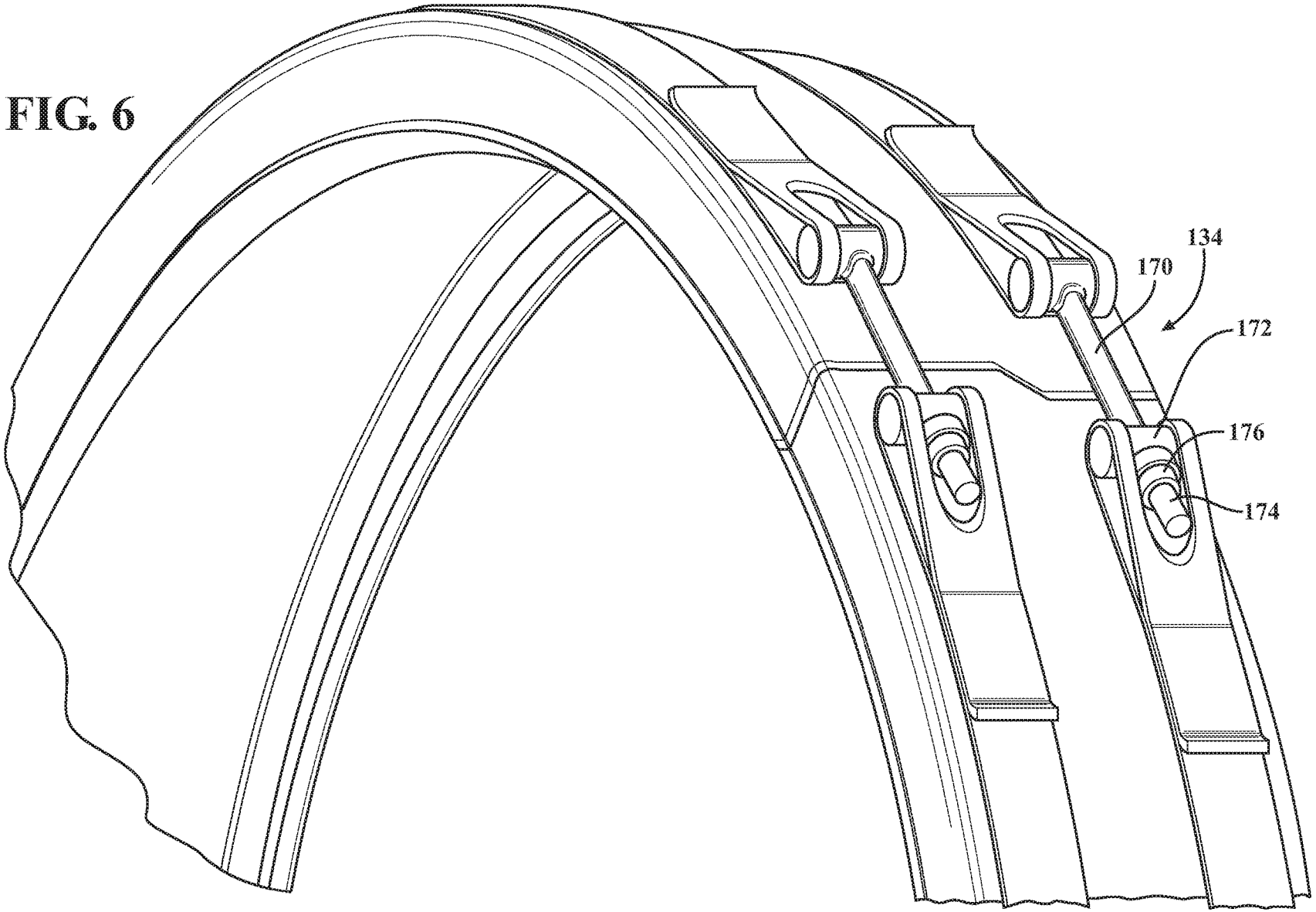
FIG. 6 is perspective view of a heat shield.
Figure 7:
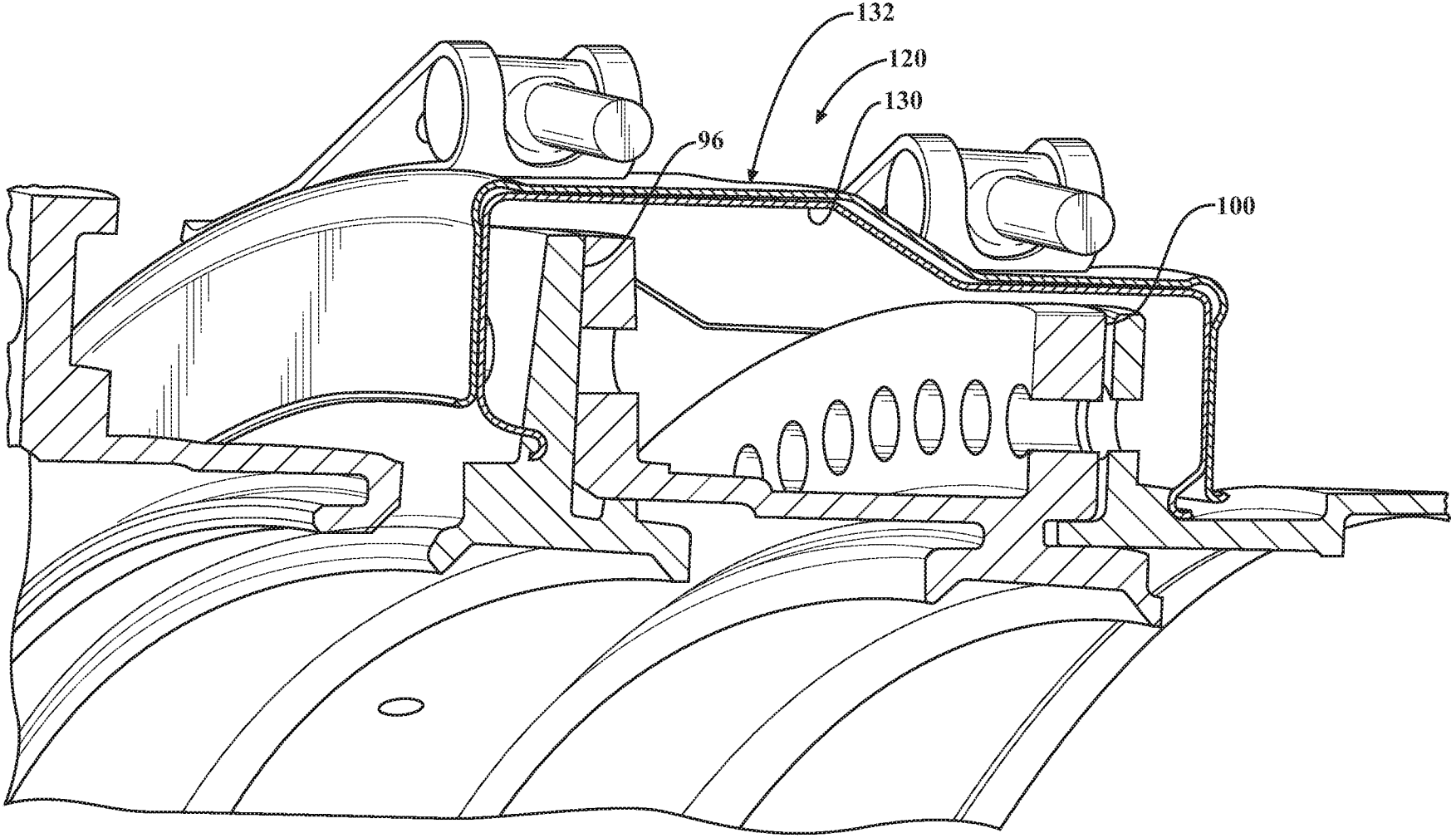
FIG. 7 is lateral sectional view of a heat shield.

With reference to FIG. 6, the band clamp 134 may includes a T-bolt 170, a dowel 172, a nut 174 and a spring 176. The spring 176 is located between the nut 174 and the dowel 172 that are received on the T-bolt 170. The spring 176 facilitates circumferential movement of the heat shield assembly in response to thermal excursions (FIG. 7).

The 2-Ply heat shield assembly 120 with the form fitted band clamp facilitates better air sealing capability than traditional heat shields, reduces cost and weight due to reduction in fasteners and retention hardware, and also reduces assembly time.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A heat shield assembly for a gas turbine engine comprising:

a first heat shield ply assembly defined about an axis;

a second heat shield ply assembly defined about the axis, the second heat shield ply assembly receivable at least partially over the first heat shield assembly; and a band clamp to circumferentially retain the first heat shield ply assembly and the second heat shield ply assembly, wherein the band clamp includes a spring to permit circumferential movement of the heat shield assembly.

2. The assembly as recited in claim 1, wherein the first heat shield ply assembly includes four segments.

3. The assembly as recited in claim 2, wherein the second heat shield ply assembly includes two segments.

4. The assembly as recited in claim 1, wherein the first heat shield ply assembly is an inner heat shield and the second heat shield ply assembly is an outer heat shield.

5. The assembly as recited in claim 1, wherein the spring is located between a nut and a dowel that are received on a T-bolt.

6. The assembly as recited in claim 1, wherein the second heat shield ply is thicker than the first heat shield ply.

7. The assembly as recited in claim 1, wherein the second heat shield ply includes a locating lobe to at least partially axially retain the band clamp.

8. A heat shield assembly for a gas turbine engine comprising:

a first heat shield ply assembly defined about an axis;

a second heat shield ply assembly defined about the axis, the second heat shield ply assembly receivable at least partially over the first heat shield assembly, wherein the second heat shield ply assembly includes a stiffening bar; and a band clamp to circumferentially retain the first heat shield ply assembly and the second heat shield ply assembly.

9. A heat shield assembly for a gas turbine engine comprising:

a first heat shield ply assembly defined about an axis;

a second heat shield ply assembly defined about the axis, the second heat shield ply assembly receivable at least partially over the first heat shield assembly; and a band clamp to circumferentially retain the first heat shield ply assembly and the second heat shield ply assembly, wherein the band clamp is riveted to the second heat shield ply.

* * * * *